US009277338B2

(12) United States Patent
Liu et al.

(10) Patent No.: US 9,277,338 B2
(45) Date of Patent: Mar. 1, 2016

(54) AUDIO CONTROL SYSTEM AND ELECTRONIC DEVICE USING SAME

(71) Applicant: ScienBiziP Consulting (Shen Zhen) Co., Ltd., Shenzhen (CN)

(72) Inventors: Lei Liu, Shenzhen (CN); Guo-Yi Chen, Shenzhen (CN)

(73) Assignee: ScienBiziP Consulting(Shenzhen) Co.,Ltd., Shenzhen (CN)

( * ) Notice: Subject to any disclaimer, the term of this patent is extended or adjusted under 35 U.S.C. 154(b) by 57 days.

(21) Appl. No.: 14/252,853

(22) Filed: Apr. 15, 2014

(65) Prior Publication Data

US 2014/0307892 A1 Oct. 16, 2014

(30) Foreign Application Priority Data

Apr. 15, 2013 (CN) ..... 2013 1 01274682

(51) Int. Cl.
*H04R 27/04* (2006.01)
*H04R 27/00* (2006.01)

(52) U.S. Cl.
CPC ..... *H04R 27/04* (2013.01); *H04R 27/00* (2013.01); *H04R 2227/003* (2013.01); *H04R 2499/11* (2013.01)

(58) Field of Classification Search
CPC ..... H04R 27/04; H04R 27/00; H04R 1/30
See application file for complete search history.

(56) References Cited

U.S. PATENT DOCUMENTS 2,731,549 A * 1/1956 Dasburg ..... H04B 7/26 246/7
6,799,159 B2 * 9/2004 Feeney ..... G10L 19/02 455/242.1
2001/0021662 A1 * 9/2001 Sanada ..... H04B 1/3827 455/567
2003/0078083 A1 * 4/2003 Meador ..... H04M 1/6505 455/575.7
2003/0210796 A1 * 11/2003 McCarty ..... H04B 3/54 381/81
2006/0088810 A1 * 4/2006 Yeh ..... G10H 1/361 434/307 A
2011/0195660 A1 * 8/2011 Okada ..... H04B 7/155 455/18

* cited by examiner

*Primary Examiner* — Simon Sing
(74) *Attorney, Agent, or Firm* — Novak Druce Connolly Bove + Quigg LLP

(57) ABSTRACT

An audio control system installed on an electronic device includes a switch switching between a first mode and a second mode, a switching module, a microphone, a microphone control module, a speaker, a speaker control module, a signal radiating module, and a signal receiving module. When the switch is switched to the first mode, the switching module controls the microphone control module to transmit audio data of microphone to the signal radiating module to radiate the audio data via a wireless network. When the switch is switched to the second mode, the switching module controls the microphone control module to transmit the audio data of microphone to the speaker to make sound via the speaker control module.

18 Claims, 2 Drawing Sheets

AUDIO CONTROL SYSTEM AND ELECTRONIC DEVICE USING SAME

FIELD

The disclosure generally relates to audio control technologies, and particularly to an audio control system and an electronic device using same.

BACKGROUND

Generally, a speaker of a communication device is used to project sound received via wireless transmission, but cannot amplify the sound received from a microphone of the communication device. Thus, when a user of the communication device wants to make a public speech, he has to turn to an audio amplifier and the other discreet speaker, which is very inconvenient and costly.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Like reference numerals designate corresponding parts throughout the views of the drawings.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one."

In general, the word "module", as used herein, refers to logic embodied in hardware or firmware, or to a collection of software instructions, written in a programming language, such as, Java, C, or assembly. One or more software instructions in the modules may be embedded in firmware, such as in an EPROM. The modules described herein may be implemented as either software and/or hardware modules and may be stored in any type of non-transitory computer-readable medium or other storage device. Some non-limiting examples of non-transitory computer-readable median include CDs, DVDs, BLU-RAY, flash memory, and hard disk drives.

Figure 1:
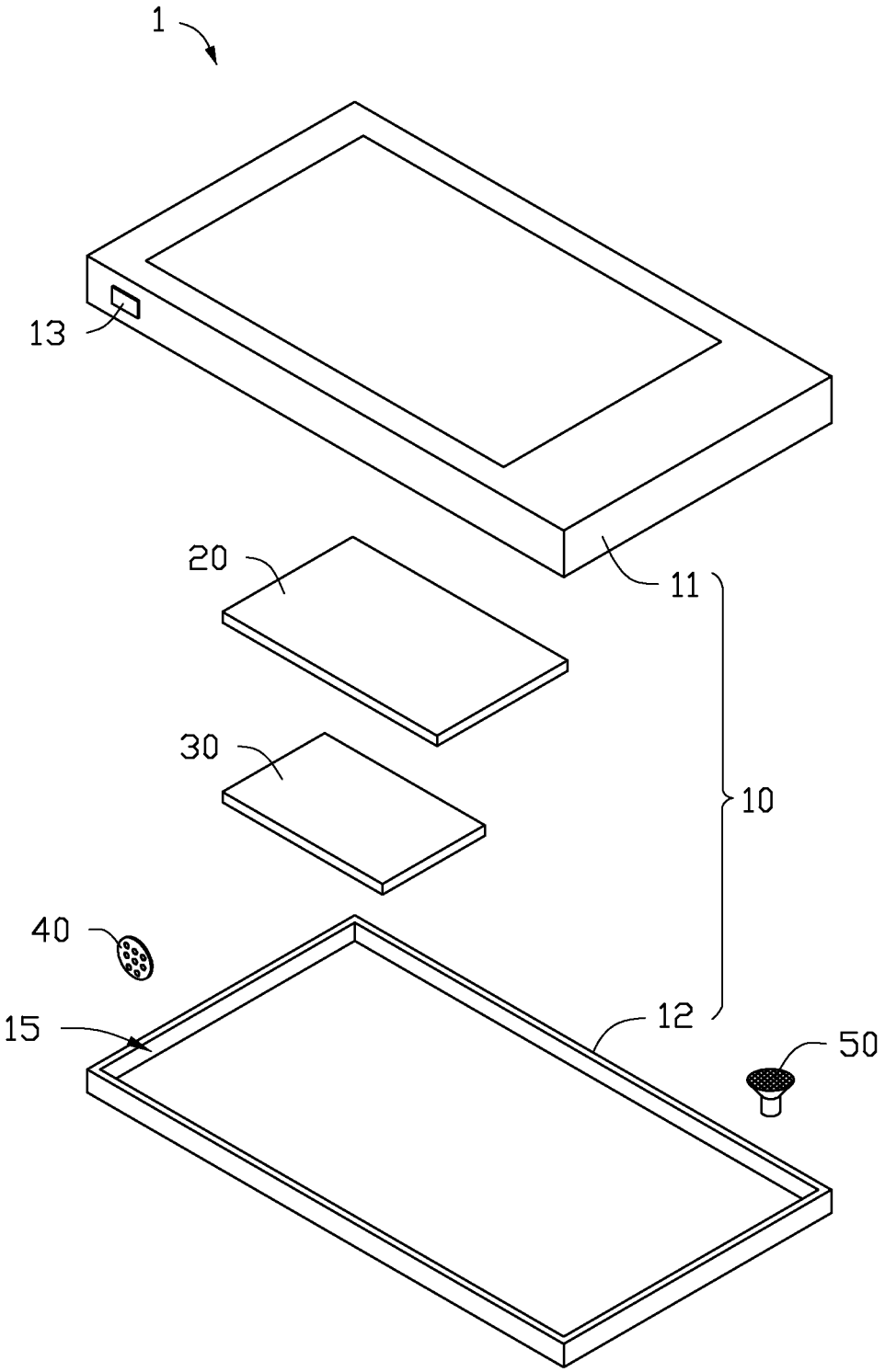
FIG. 1 is an isometric, exploded view of an embodiment of an electronic device.
Figure 2:
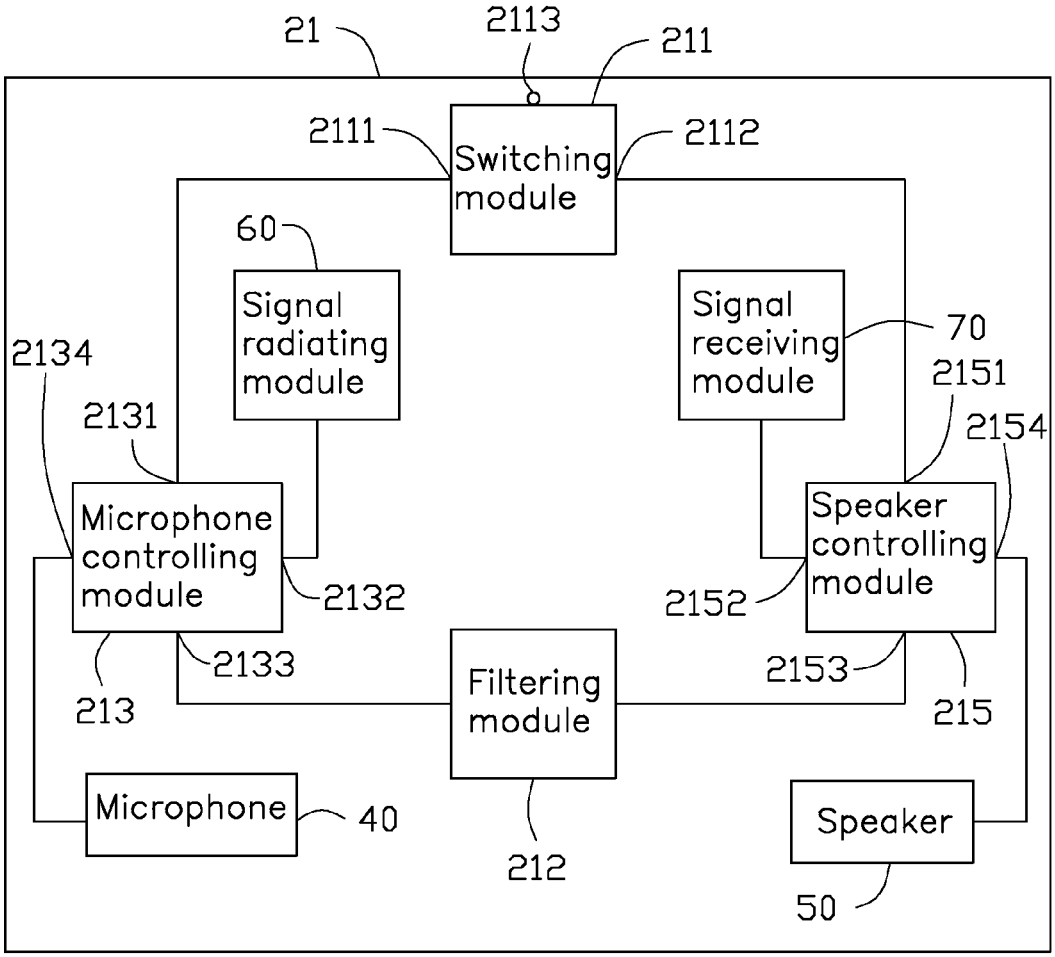
FIG. 2 is a diagram of an audio control system of an embodiment of the present disclosure.

FIG. 1 shows an electronic device 1 in accordance with an embodiment of the present disclosure. FIG. 2 shows an audio control system 21 installed on the electronic device 1. The audio control system 21 is used to control the electronic device 1 to directly sound a voice or the audio data received via a wireless network. The electronic device 1 may be, but is not limited to, a cellular phone, an electronic book, a tablet computer, a mobile internet device (MID), or a portable music player.

The electronic device 1 includes a main body 10, a circuit board 20, and a power source 30. The main body 10 includes a first part 11 and a second part 12. The circuit board 20 and the power source 30 are received in a receiving space 15 cooperatively defined by the first part 11 and the second part 12. The circuit board 20 includes a number of circuits, such as a graphic processing circuit and a backlight driving circuit, set thereon to execute specific operations of the electronic device 1.

The audio control system 21 includes a switch 13, a microphone 40, a speaker 50, a signal radiating module 60, a signal receiving module 70, a switching module 211, a microphone control module 213, a filtering module 212, and a speaker control module 215 (as shown in FIG. 3). The switch 13 is used to be operated by the user to generate a control signal. The switch 13 can be set on the first part 11 or the second part 12. The switch 13 is switched between a speaker mode and a normal mode. When the switch 13 is switched to the speaker mode, the control signal is generated and transmitted to the audio control system 21. The power source 30 provides power to the electronic device 1. The microphone 40 and the speaker 50 are received in the receiving space 15. The signal radiating module 60, the signal receiving module 70, the switching module 211, the microphone control module 213, the filtering module 212, and the speaker control module 215 may be different microcontrollers set on the circuit board 20 or programs stored and implemented by the electronic device 1. In this embodiment, the microphone control module is a single-ended microphone chip and the filtering module is a filter capacitor. In the other embodiment, the microphone control module is a differential microphone.

The switching module 211 includes a first output terminal 2111, a second output terminal 2112, and a control terminal 2113. The switching module 211 outputs a first switching signal via the first output terminal 2111 and outputs a second switching signal via the second output terminal 2112 according to the control signal generated by the switch 13. The control terminal 2113 is connected to the switch 13 to receives the control signal.

The microphone control module 213 includes a first receiving terminal 2131, a microphone terminal 2134, a radiating terminal 2132, and a transmission terminal 2133. The first receiving terminal 2131 is connected to the first output terminal 2111 to receive the first switching signal from the switching module 211. The microphone terminal 2134 is connected to the microphone 40. The microphone 40 transforms the voice of the user to audio data and transmits the audio data to the microphone control module 213. The radiating terminal 2132 is connected to the signal radiating module 60. The signal radiating module 60 transforms the audio data from the radiating terminal 2132 into electromagnetic signal and radiates the electromagnetic signal via the wireless network. The transmission terminal 2133 is connected to the speaker control module 215 through the filtering module 212. The filtering module 212 filters out noise from the audio data when the audio data is transmitted from the transmission terminal 2133 to the speaker control module 215 by passing the audio data through the filtering module 212.

The speaker control module 215 includes a second receiving terminal 2151, a receiver terminal 2152, a connection terminal 2153, and a speaker terminal 2154. The second receiving terminal 2151 is connected to the second output terminal 2112 to receives the second switching signal. The second receiver terminal 2151 is connected to the signal receiving module 70. The signal receiving module 70 receives electromagnetic signal transmitted via the wireless network and transforms the electromagnetic signal to the audio data. The connection terminal 2153 is connected to the transmission terminal 2133 via the filtering module 212 to receive the audio data transmitted from the microphone control module 213. The speaker terminal 2154 is connected to the speaker 50. The speaker 50 amplifies the audio data and transforms the amplified audio data to sound.

In operation, when the switch 13 is switched to the normal mode, there is no signal transmitted to the control terminal 2113 of the switching module 211. The switching module 211 controls the microphone control module 213 to shut the transmission terminal 2133 when the switching module 211 does not receive any signal. Thus, the audio data generated by the microphone 40 is transmitted to the signal radiating module 60 and radiated as the electromagnetic signal via the wireless network. The switching module 211 controls the speaker control module 215 to shut the connection terminal 2153 when not receiving any signal. Thus, the audio data received by the signal receiving module 70 is transmitted to the speaker 50 for broadcasting by the speaker 50.

When the switch 13 is switched to the speaker mode, the control signal is transmitted to the switching module 211. The switching module 211 controls the microphone control module 213 to shut the radiating terminal 2132 and the speaker control module 215 to shut the receiver terminal 2152 when receiving the control signal. Thus, the audio data generated by the microphone 40 is transmitted to the speaker 50 through the filtering module 212, then is amplified and transformed to sound via the speaker 50.

In this embodiment, the switching module 211 shuts the transmission terminal 2133 and the connection terminal 2153 by not transmitting a signal to the microphone control module 213 and the speaker control module 215. The switching module 211 shuts the radiating terminal 2132 by transmitting the first switching signal to the microphone control module 213. The switching module 211 shuts the receiver terminal 2152 by transmitting the second switching signal to the speaker control module 215. In the other embodiments, the switching module 211 can transmit signals to shut the transmission terminal 2133 and the connection terminal 2153 and transmits no signal to shut the radiating terminal 2132 and the receiver terminal 2152, or correspondingly transmits different signals to shut the transmission terminal 2133, the connection terminal 2153, the radiating terminal 2132, and the receiver terminal 2152.

The electronic device 1 having the audio control system 21 can conveniently switch between the speaker mode of directly broadcasting the user's voice and the normal mode of broadcasting the audio data received via the wireless network. Thus, the user can easily make public speeches by using the electronic device 1.

It is believed that the present embodiments and their advantages will be understood from the foregoing description, and it will be apparent that various changes may be made thereto without departing from the scope of the disclosure or sacrificing all of its material advantages. the examples hereinbefore described merely being exemplary embodiments.

What is claimed is:

1. An audio control system of an electronic device, the system comprising:

a switch switching between a first mode and a second mode;

a switching module connected to the switch;

a microphone control module connected to the switching module;

a microphone connected to the microphone control module, the microphone control module configured to transform voice data into audio data;

a speaker control module connected to the switching module and the microphone control module;

a speaker connected to the speaker control module, and the speaker control module configured to transform audio data into sound;

a signal radiating module connected to the microphone control module and configured to radiate audio data via a wireless network; and a signal receiving module connected to the speaker control module and receiving audio data transmitted from the wireless network;

wherein the switching module controls the microphone control module to transmit the audio data of the microphone directly to the signal radiating module to radiate the audio data into the air; the speaker control module to transmit the audio data received from the wireless network to the speaker to sound when the switch is switched to the first mode, and the microphone control module to transmit the audio data of the microphone directly to the speaker to sound via the speaker control module when the switch is switched to the second mode.

2. The audio control system of claim 1, wherein the switching module comprises a controlling terminal connected to the switch, a first output terminal connected to the microphone control module, and a second output terminal connected to the speaker control module, the switch transmits a controlling signal to the switching module when is switched to the second mode, the switching module transmits a first switching signal to the microphone control module via the first output terminal when receives the controlling signal, and the switching module transmits a second switching signal to the speaker control module via the second output terminal when receives the controlling signal.

3. The audio control system of claim 2, wherein the microphone control module comprises a first receiving terminal connected to the first output terminal to receives the first switching signal, a microphone terminal connected to the microphone to receives the audio data, a radiating terminal connected to the signal radiating module to transmit the audio data to the signal radiating module, and a transmission terminal connected to the speaker control module to transmit the audio data to the speaker control module.

4. The audio control system of claim 3, wherein the speaker terminal comprises second receiving terminal connected to the second output terminal to receives the second switching signal, a receiver terminal connected to the signal receiving module to receives the audio data transmitted via the wireless network, a connection terminal connected to the transmission terminal to receives the audio data from the microphone control module, and a speaker terminal connected to the speaker to transmit the audio data to the speaker.

5. The audio control system of claim 4, further comprising a filtering module connected between the transmission terminal and the connection terminal and filtering out noise from the audio data transmitted from the microphone control module and the speaker control module.

6. The audio control system of claim 4, wherein the microphone control module transmits the audio data of the microphone directly to the signal radiating module by shutting the transmission terminal and the microphone control module transmits the audio data of the microphone directly to the speaker by shutting the radiating terminal.

7. The audio control system of claim 4, wherein the speaking control module transmits the audio data received from the wireless network to the speaker by shutting the connection terminal and the speaking controlling module transmits the audio data of microphone to the speaker by shutting the receiver terminal.

8. The audio control system of claim 1, wherein the microphone control module is selected from a single-ended microphone chip or a differential microphone chip.

9. The audio control system of claim 1, wherein the filtering module is a filter capacitor.

10. An electronic device comprising:

a main body;

a circuit board received in the main body;

a power source received in the main body and provides power to the electronic device; and an audio control system installed on the circuit board comprising:

a switch that switches between a first mode and a second mode;

a switching module connected to the switch;

a microphone control module connected to the switching module;

a microphone connected to the microphone control module and configured to transform voice of a user into audio data;

a speaker control module connected to the switching module and the microphone control module;

a speaker connected to the speaker control module and configured to transform audio data into sound;

a signal radiating module connected to the microphone control module and configured to radiate audio data via a wireless network; and a signal receiving module connected to the speaker control module and configured to receive audio data transmitted from the wireless network;

wherein the switching module controls the microphone control module to transmit the audio data of the microphone directly to the signal radiating module to radiate the audio data into the air and the speaker control module to transmit the audio data received from the wireless network to the speaker to sound when the switch is switched to the first mode, and the switching module controls the microphone control module to transmit the audio data of the microphone directly to the speaker to sound via the speaker control module when the switch is switched to the second mode.

11. The electronic device of claim 10, wherein the switching module comprises a controlling terminal connected to the switch, a first output terminal connected to the microphone control module, and a second output terminal connected to the speaker control module, the switch transmits a controlling signal to the switching module when is switched to the second mode, the switching module transmits a first switching signal to the microphone control module via the first output terminal when receives the controlling signal, and the switching module transmits a second switching signal to the speaker control module via the second output terminal when receives the controlling signal.

12. The electronic device of claim 11, wherein the microphone control module comprises a first receiving terminal connected to the first output terminal to receives the first switching signal, a microphone terminal connected to the microphone to receives the audio data, a radiating terminal connected to the signal radiating module to transmit the audio data to the signal radiating module, and a transmission terminal connected to the speaker control module to transmit the audio data to the speaker control module.

13. The electronic device of claim 12, wherein the speaker terminal comprises second receiving terminal connected to the second output terminal to receives the second switching signal, a receiver terminal connected to the signal receiving module to receives the audio data transmitted via the wireless network, a connection terminal connected to the transmission terminal to receives the audio data from the microphone control module, and a speaker terminal connected to the speaker to transmit the audio data to the speaker.

14. The electronic device of claim 13, further comprising a filtering module connected between the transmission terminal and the connection terminal and filtering out noise from the audio data transmitted from the microphone control module and the speaker control module.

15. The electronic device of claim 13, wherein the microphone control module transmits the audio data of the microphone directly to the signal radiating module by shutting the transmission terminal and the microphone control module transmits the audio data of the microphone directly to the speaker by shutting the radiating terminal.

16. The electronic device of claim 13, wherein the speaking control module transmits the audio data received from the wireless network to the speaker by shutting the connection terminal and the speaking controlling module transmits the audio data of microphone to the speaker by shutting the receiver terminal.

17. The electronic device of claim 10, wherein the microphone control module is selected from a single-ended microphone chip or a differential microphone chip.

18. The electronic device of claim 10, wherein the filtering module is a filter capacitor.

* * * * *